US005557393A

United States Patent [19]

Goodman et al.

[11] Patent Number: 5,557,393

[45] Date of Patent: Sep. 17, 1996

[54] PROCESS AND APPARATUS FOR ACHIEVING CUSTOMER SELECTABLE COLORS IN AN ELECTROSTATOGRAPHIC IMAGING SYSTEM

[75] Inventors: Nancy B. Goodman; Richard P. Germain; Paul C. Julien, all of Webster; Susan J. Kremer, Rochester; Robert J. Gruber, Pittsford, all of N.Y.

[73] Assignee: Xerox Corporation, Stamford, Conn.

[21] Appl. No.: 334,082

[22] Filed: Nov. 4, 1994

[51] Int. Cl.[6] ..... G03G 15/01

[52] U.S. Cl. ..... 355/326 R; 118/653; 355/245; 355/328; 430/105; 430/106

[58] Field of Search ..... 355/245, 247, 355/251, 252, 253, 259, 260, 261, 326 R, 328; 118/653, 654; 430/105, 106, 106.6, 107, 109, 120, 122, 103

[56] References Cited

U.S. PATENT DOCUMENTS

| | | | |
|---|---|---|---|
| 3,013,890 | 12/1961 | Bixby . | |
| 4,078,929 | 3/1978 | Gundlach . | |
| 4,312,932 | 1/1982 | Hauser et al. . | |
| 4,395,471 | 7/1983 | Hauser et al. . | |
| 4,614,165 | 9/1986 | Folkins et al. . | |
| 5,032,872 | 7/1991 | Folkins et al. . | |
| 5,034,773 | 7/1991 | Nimura et al. | 118/653 X |
| 5,120,632 | 6/1992 | Bertrand et al. | 430/109 |
| 5,204,208 | 4/1993 | Paine et al. . | |
| 5,305,070 | 4/1994 | Snelling | 355/326 R |
| 5,370,962 | 12/1994 | Anderson et al. | 430/106 X |
| 5,404,208 | 4/1995 | Edmunds | 355/247 |

*Primary Examiner*—Sandra L. Brase
*Attorney, Agent, or Firm*—Oliff & Berridge; Eugene O. Palazzo

[57] ABSTRACT

An electrostatographic imaging process includes forming an electrostatic latent image on an image forming device, developing the electrostatic latent image on the image forming device with at least one developer containing carrier particles and a blend of two or more compatible toner compositions, and transferring the toner image to a receiving substrate and fixing it thereto. Among the compatible toner compositions that may be selected are toner compositions having blend compatibility components coated on an external surface of the toner particles and particulate toner compositions containing therein blend compatibility components or passivated pigments. Electrostatographic imaging devices, including a tri-level imaging device and a hybrid scavengeless development imaging device, are also provided for carrying out the described process. The processes and apparatus of the present invention are especially useful in imaging processes for producing single color or highlight color images using customer selectable colors, or for adding highlight color to a process color image produced by the same apparatus.

32 Claims, 4 Drawing Sheets

PROCESS AND APPARATUS FOR ACHIEVING CUSTOMER SELECTABLE COLORS IN AN ELECTROSTATOGRAPHIC IMAGING SYSTEM

BACKGROUND OF THE INVENTION

This invention relates to a process and apparatus for achieving customer selectable colors in a development device, such as an electrostatographic imaging system. More particularly, this invention relates to a process and apparatus for achieving customer selectable colors and customer selectable highlight colors in an electrostatographic imaging device using a hybrid development system or a conductive magnetic brush development system and a developer composition comprised of a blend of two or more toners from a base set of compatible color toner compositions. These may be incorporated into either a conventional single or multipass electrostatographic system or a tri-level single pass highlight color electrophotographic system. This invention also relates to a process and apparatus wherein two or more toner compositions from the base set of compatible color toner compositions are mixed with carrier particles in the development apparatus, enabling on-line color selection and correction.

Generally, the process of electrostatographic printing includes the step of charging an imaging member to a substantially uniform potential to sensitize the surface thereof. The charged portion of the surface is exposed to an image, such as an image of an original document being reproduced, or to a computer-generated image written by a raster output scanner. This records an electrostatic latent image on the imaging member corresponding to the original document or computer generated image. The recorded latent image is then developed by bringing a developer material into contact therewith. In a tri-level system, three separate potential levels are used. The unexposed areas of the latent image are developed in one color, and the fully discharged areas are developed in another color; the partially exposed areas remain undeveloped. This forms a toner powder image on the imaging member that is subsequently transferred to a substrate, such as paper. Finally, the toner powder image is permanently affixed to the substrate in image configuration, for example by heating and/or pressing the toner powder image.

A suitable developer material may be a two-component mixture of carrier particles having toner particles triboelectrically adhered thereto. The toner particles are attracted to and adhere to the electrostatic latent image to form a toner powder image on the imaging member surface. Suitable single component developers are also known. Single component developers comprise only toner particles; the particles have an electrostatic charge (for example, a triboelectric charge) so that they will be attracted to, and adhere to, the latent image on the imaging member surface.

There are various known forms of development systems for bringing toner particles to a latent image on an imaging surface. One form includes a magnetic brush roll that picks up developer from a reservoir through magnetic attraction and carries the developer into proximity with the latent image. In a modification of the magnetic brush apparatus, known as hybrid development, the magnetic brush roll does not bring toner directly to the imaging member surface, but transfers toner to a donor roll that then carries the toner into proximity with the latent image. In single component scavengeless development, a donor roll is used with a plurality of electrode wires closely spaced from the donor roll in the development zone. An AC voltage is applied to the wires to form a toner cloud in the development zone and the electrostatic fields generated by the latent image attract toner from the cloud to develop the latent image. In a hybrid scavengeless development system, the method of development with a donor roll is the same as in single component scavengeless development, except that a magnetic brush is first used to load the donor roll with toner. In single component jumping development, an AC voltage is applied to the donor roll, causing toner to be detached from the roll and projected towards the imaging member surface. The toner is attracted by the electrostatic fields generated by the latent image and the latent image is developed. Variants of these development systems may be used with single component or two-component developers.

For example, U.S. Pat. No. 5,032,872 to Folkins et al. describes the use of a hybrid scavengeless development system having dual donor rolls and electrically biased electrodes for each donor roll. The hybrid development system uses a two-component magnetic brush to supply toner particles to one or more donor rolls, which in turn load the toner particles onto a wire in the development nip for developing the latent image. Although the described hybrid development system contains multiple donor rolls, the separate donor rolls are supplied with toner from a common developer reservoir by a common magnetic brush roll.

Various forms of systems for producing two-color developed images are also known. For example, U.S. Pat. No. 4,078,929 to Gundlach teaches the use of a tri-level electrostatographic system as a means to achieve singlepass highlight color images. Gundlach teaches a method for two-color development of an electrostatic charge pattern of a single polarity and having three different levels of potential by utilizing relatively negatively charged toner particles of one color and relatively positively charged toner particles of a second color. In this method, the photoreceptor is initially charged to a voltage $V_0$. It is then selectively discharged with a single raster output scanner to approximately $V_0/2$ in the background areas and to near 0 or residual potential in the color areas. The fully discharged areas are printed in color, and the unexposed areas, which undergo dark discharge, are printed in black (or a second color). Alternatively, the colors may be reversed, i.e., the unexposed areas may be developed in color, and the areas of near 0 or residual potential may be developed in black (or a different color).

Another method of two-color reproduction is disclosed in U.S. Pat. No. 3,013,890 to Bixby. Bixby teaches a method in which a charge pattern of either a positive or negative polarity is developed by a single, two-color developer. The developer of Bixby comprises a single carrier that supports both triboelectrically relatively positive and relatively negative toner. The positive toner is a first color and the negative toner is a second color. The method of Bixby develops positively charged image areas with the negative toner and develops negatively charged image areas with the positive toner. A two-color image occurs only when the charge pattern includes both positive and negative polarities.

Toner compositions and methods for producing such compositions are known.

Several methods of producing blended color toners and developers are also known. Traditionally, the methods have focused on combining multiple colorants into a single toner composition, or using multiple separate developers each containing a single colored toner. For example, U.S. Pat. No. 4,312,932 to Hauser et al. discloses toners and developers wherein the developing composition comprises a single carrier and toner resin particles containing up to four pigments. Suitable pigments are described to be those selected from magenta, cyan, yellow and white. The process involves incorporating multiple appropriate pigments into the toner resin, for example, by blending the pigments together in the molten resin polymer during the processing and preparation of the toner resin, to yield a toner or developer with the desired specific color.

As a further example, U.S. Pat. No. 4,395,471 to Hauser et al. describes a process whereby three color toners are mixed in an appropriate ratio to yield a final toner composition of a desired specific color. In that process, specified amounts of previously-prepared yellow, cyan, and/or magenta toners are mixed together in their powdered or ground form and then combined with a single carrier to yield a developer with a specific color. The toners and process of the reference are disclosed as especially useful in flat color copying, which requires the use of halftoning if paler colors are to be produced. A similar process is also disclosed in U.S. Pat. No. 5,204,208 to Paine et al., which describes forming a customized color toner by mixing together specified amounts of at least two encapsulated toners of different colors.

A group of compatible toner and developer compositions, which allow for easier mixing of the separate color toners in various combinations, is disclosed in allowed U.S. Ser. No. 08/024,134 filed on Mar. 1, 1993. Disclosed are toner compositions that may be used to provide a palette, that is for example a set of pre-selected color toners or an extended set of colors, by admixing certain toner compositions. Thus, a small starting set of toners, such as red, green, blue, cyan, magenta and yellow, may be mixed or blended to generate many other colors by the method of co-mixing two or more of these toners, to provide toners with pre-selected colors. Each new co-mixture, with a relative ratio of the constituent toners, may become a new toner to be added to a carrier to form a developer composition particularly useful in tri-level or color electrophotographic processing. The toner compositions are disclosed as usually containing pigment particles comprised of, for example, carbon black, magnetite, cyan, magenta, yellow, blue, green, red or brown components, or mixtures thereof, thereby providing for the development and generation of black and/or colored images. The toner compositions possess excellent admix characteristics and maintain their triboelectric charging characteristics for an extended number of imaging cycles.

Highlight color and customer selectable color printing is a very difficult process. Due to the strict requirements of triboelectric charging, admix and fusing characteristics of the toner composition, it is often difficult to design even a single toner composition for a tri-level printing process. This is especially true as faster and more complex imaging and printing methods are being developed, as more copies or prints are being made by the systems, and as the demands made on the toner and developer compositions are ever increasing. These concerns are further heightened in processes of the present invention, where a blend of two or more base color toners is used to form a final color toner composition.

For example, in the case of a hybrid development system or a hybrid scavengeless development system, development of the electrostatic latent image essentially occurs twice. First, the blend of the base color toners is transferred to (developed uniformly on) a donor roll; and second the blend is transferred to (developed imagewise on) an imaging member to develop the latent image. In each step, the blend of the base color toners must be homogeneous, in order to ensure that the color of the final developed image is uniform.

In the case of a tri-level development system, the concerns for formulating each of the toners is further exacerbated by the fact that the triboelectric charging requirements are more strict. For example, in a conventional tri-level imaging system, each of the two toners being used must have a different triboelectric value, must be relatively oppositely charged with respect to an intermediate potential, and must not interact with each other or with other portions of the latent image. As such, the formulation of each of the two toners must account for such factors as how the triboelectric charge of the toner particles will be affected once the toner is charged into a developer housing with carrier particles. In the case of blends of toner compositions in one developer housing, it is further required that the constituent toners (i.e. the base color toners) also be formulated to account for the effects on the triboelectric charge of the individual toners as they are mixed together.

Furthermore, in all of the development systems, the toner formulations must also account for the ever-increasing demands being placed upon the process and the individual system components. For example, as more prints are being made over the same period of time, it is necessary that the toner and developer compositions exhibit higher stability than was previously required. Similarly, the toner and developer must exhibit improved admix characteristics in order to ensure uniform triboelectric charge as fresh toner or replenisher is added to the development system and to ensure a uniform blend of the developer materials. At the same time, higher print quality is being demanded from the toner compositions, including blended toner compositions.

SUMMARY OF THE INVENTION

A need continues to exist for improved color toner compositions and electrostatographic imaging systems to produce color electrostatographic copies or prints and for use in highlight color copying or printing. Specifically, the need exists for an electrostatographic imaging system wherein various base color toner compositions may be blended and used in a single developer housing to achieve a broad range of customer selectable colors to produce single-color or multi-color copies. As such, the need also continues to exist for a set of base color toner compositions that are compatible with each other and can be mixed in varying proportions without requiring that the triboelectric charging properties of the resultant blended toner composition be reformulated. Such improved color toner compositions, and an improved electrostatographic imaging system using such toner compositions, are provided in this invention.

Specifically, this invention provides an electrostatographic imaging process comprising:

a) forming an electrostatic latent image on an image forming device;

b) developing said electrostatic latent image on said image forming device with at least one first developer, said first developer comprising carrier particles and a blend of two or more toner compositions, said toner compositions being selected from the group consisting of toner compositions having blend compatibility components coated on an external surface of particles of said toner compositions and particulate toner compositions containing therein blend compatibility components or passivated pigments;

c) transferring said toner image to a receiving substrate and fixing it thereto.

This invention also provides electrostatographic imaging devices, for example for use in tri-level and hybrid development systems, for practicing the described process. The process and apparatus of the present invention are especially useful in imaging processes for producing single color or highlight color images using customer selectable colors.

In embodiments of the present invention, the toner compositions and development systems also provide distinct economic advantages over conventional processes. For example, by providing a small set of base color toners, it is possible to inventory only a small number of distinct toner compositions; but those base color toners can be mixed to form a wide range of customer selectable colors. Additionally, the base color toners can be economically mixed in small batches to produce specialty colors as desired. Consequently, a significant amount of research and development time and expense is saved because the base color toners can be blended in various proportions without having to reformulate the charging and fixing properties of the resultant toner composition and/or modify the development apparatus to accommodate the new toner blend.

DETAILED DESCRIPTION OF PREFERRED EMBODIMENTS

Figure 1:
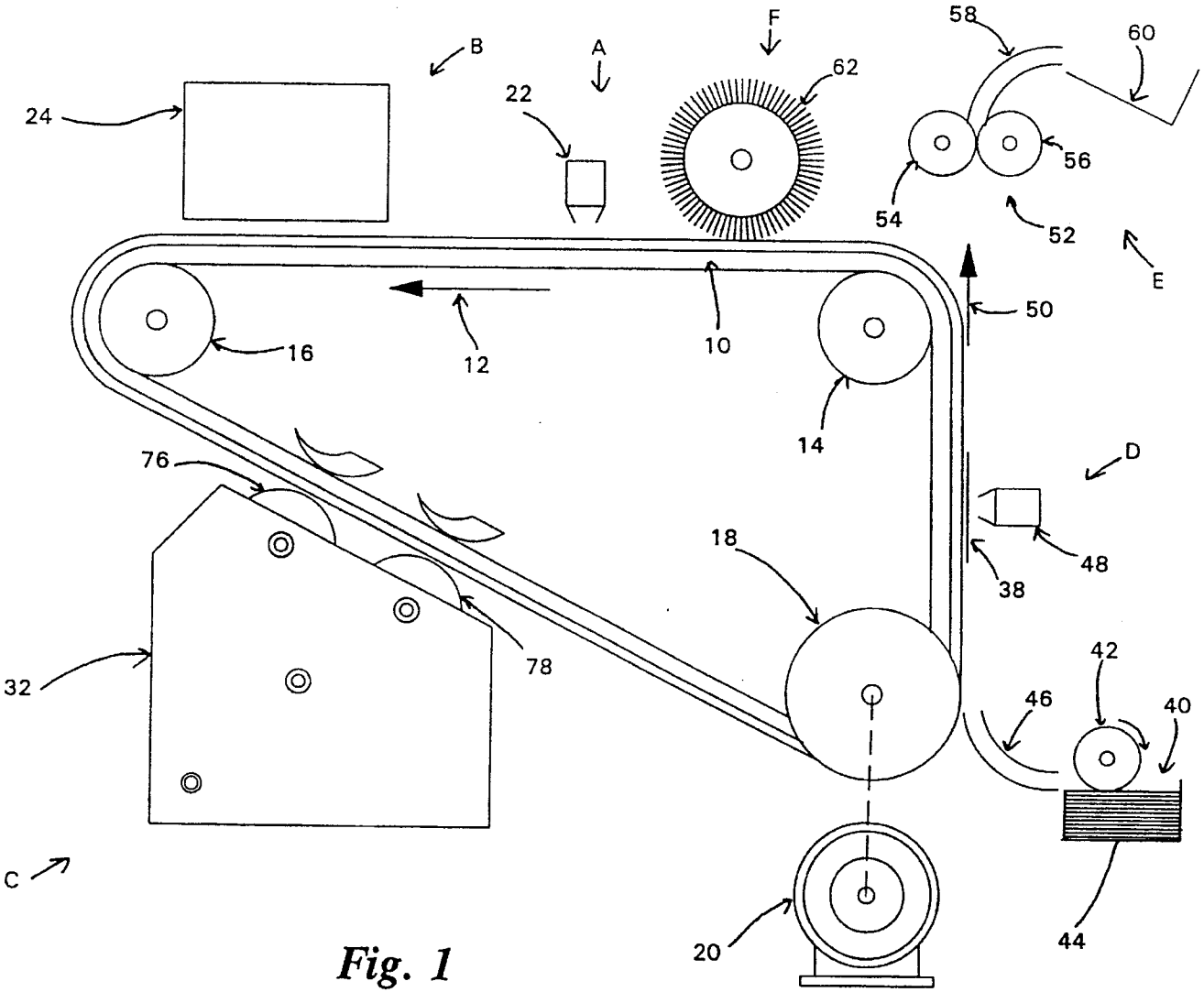
FIG. 1 is a schematic diagram depicting an illustrative electrostatographic imaging machine having a single developer housing.

The present invention provides a developer composition comprised of a blend of separate base color toner compositions, and a single carrier. The compatible base color toners may be mixed in varying proportions with a single carrier to provide a final toner composition of a desired specific color.

Also provided is an electrostatographic development system utilizing the developer composition. In embodiments, the development system may comprise one or more separate developer housings. The present invention therefore provides an electrostatographic imaging process that may be used to produce single-color or multi-color prints, wherein the specific color or colors may be selected from a wide gamut of colors.

As described in further detail below, the base color toner compositions (collectively referred to herein as the base color toners) may be combined into the developer composition of the present invention either prior to or during the imaging process. That is, the toner compositions may be blended and mixed with a carrier and contained in a single dispenser, or the toner compositions may be provided in separate dispensers and mixed together with a carrier as they are dispensed into a single development apparatus. This latter method allows for color selection by the customer and on-line color adjustment during actual use of the development system.

To ensure that the base color toner compositions may be blended in various proportions to yield specific customer selectable colors without having to reformulate the charging, admix, and other properties of the individual base color toners or of the resultant blend, it is essential that they be compatible. Thus, the black, white and/or colored base color toners to be blended should possess similar characteristics, such as similar flow, conductivity, charging (e.g., triboelectric charging) and admix characteristics. Compatibility of the base color toners enables blending of the toners without requiring that such properties as the triboelectric charging and fusing temperature of the resultant customer selectable color toner be reformulated. It is especially preferred that the base color toners used in the present invention possess blend compatibility with each other. Such toner compositions are disclosed, for example, in U.S. allowed Ser. No. 08/024,134 filed on Mar. 1, 1993, the entire disclosure of which is incorporated herein by reference. Generally, the toner compositions comprise resin particles, pigment particles, optional internal charge enhancing additives dispersed therein and blend compatibility components, which in embodiments may be coated on the surface of the particles. In this way, the various toner compositions can be effectively blended, enabling the production of toner compositions of a pre-selected specific color and having excellent resolution and superior color intensity. The production of such toner compositions is also described in allowed U.S. Ser. No. 08/024,134 filed on Mar. 1, 1993, which has been fully incorporated herein.

The primary function of the blend compatibility components is therefore to provide improved blend compatibility as measured by the separation, or lack thereof, in the charge spectrum of the toner blend and the admix time of the blend. The external blend compatibility component is not, it is believed, functioning as a primary charge director, as in fixing or moving the triboelectric charge of the toners, such as with external charge enhancing additives. However, movement of the triboelectric charge may be acceptable provided the improved blend compatibility is achieved.

The blend compatibility component may be added to the toner particles as an external additive by known methods. For example, the blend compatibility component is typically applied to the toner or toners by mechanical mixing. If the blend compatibility component is applied to the individual toner compositions separately, then the separate base color toners may subsequently be combined to form a blend by any number of mixing processes, such as tumbling or mechanical blending. However, in embodiments, it may be desirable to apply the blend compatibility component to a pre-mixed blend of base color toners. In this case, there is typically used a mechanical blending process wherein all of the separate toners, the blend compatibility component and any other external additives are combined together.

In embodiments of the present invention, the blend compatibility components may be incorporated into the toner particles as internal additives, rather than being coated on the surface of the toner particles. Thus, for example, the blend compatibility components may be incorporated into the toner resins by polymerizing the resins in the presence of the blend compatibility components. As a further example, the blend compatibility components can be blended into the toner particles at the same time that other internal additives, such as colorants, charge enhancing additives, and the like are being blended with the toner resin.

Alternatively, the base color toners of the present invention may be produced without the inclusion of a separate blend compatibility component in the toner compositions.

Instead, it is possible in embodiments of the present invention to utilize base color toners wherein the toner particles are passivated, i.e., wherein components of the toner composition, such as the colorants and charge enhancing additives, are selected so that they do not significantly alter the flow, conductivity, charging and admix properties of the toner. For example, the base color toners of the present invention may incorporate, as the colorant material, passivated pigments and/or dyes or may include passivated charge enhancing additives. Such passivated pigments or charge enhancing additives may be in addition to, or as a substitute for, the blend compatibility component described above.

Examples of charge enhancing additives that effectively passivate the toner compositions in which they are contained include charge enhancing additives comprising diblock copolymers, such as ionophoric and ionomeric polymers. Such compositions are disclosed, for example, in U.S. Pat. Nos. 4,592,989 and 5,314,778, both to Smith et al., which are totally incorporated herein by reference. U.S. Pat. No. 4,592,989 discloses an electrostatic toner composition comprised of resin particles, pigment particles and a complex of a dipolar molecule or salt attached to an ionophoric polymer; whereas U.S. Pat. No. 5,314,778 discloses ionomeric polymers optionally complexed to a Lewis acid, a salt, or an ion thereof as charge enhancing additives in toner compositions.

Examples of passivated pigments also include similar diblock copolymers, and are disclosed, for example, in U.S. Ser. No. 08/313,956 filed Sep. 28, 1994, the full disclosure of which is totally incorporated herein by reference. The passivated pigments and/or dyes may therefore include soluble ionic dyes that can be bound to ionophoric or ionomeric segments of block copolymers.

In this way, a set of compatible particulate toner compositions may be formed. As used herein, the term particulate toner is meant to describe any of various toner compositions other than encapsulated toners. Thus, for example, particulate toners include, but are not limited to, toners formed by such processes as attrition and emulsion aggregation.

As a further alternative, compatible encapsulated toner compositions may be used as the base color toners in the present invention. In embodiments where encapsulated toners are used for the base color toners, it is preferred that the encapsulated toners be passivated as to the colorant materials of the capsules. That is, it is preferred that the triboelectric charging characteristics of the capsules be independent of the pigments and other materials contained in the core of the capsules. Such encapsulated toner compositions are described, for example, in U.S. Pat. No. 5,204,208, the entire disclosure of which is incorporated herein by reference.

Blend compatibility components are known and can be selected for use with the toner compositions of the present invention. These blend compatibility components may be coated on the surface of the toner particles as external additives, or may be incorporated into the toner particles as internal additives. Examples of blend compatibility components that may be selected include, but are not limited to, quaternary ammonium compounds; distearyl dimethyl ammonium methyl stearate; zinc salt complexes such as Bontron E84™ and aluminum salt complexes such as Bontron E88™ (both available from Orient Chemical Co.), as disclosed in U.S. Pat. No. 4,845,003, the entire disclosure of which is incorporated herein by reference; organic sulfonates such as stearylphenethyldimethyl ammonium tosylate (SPDAT); trialkyl hydrogen ammonium bisulfate such as distearyl methyl hydrogen ammonium bisulfate, trimethyl hydrogen ammonium bisulfate, triethyl hydrogen ammonium bisulfate, tributyl hydrogen ammonium bisulfate, dioctyl methyl hydrogen ammonium bisulfate, didodecyl methyl hydrogen ammonium bisulfate, and dihexadecyl methyl hydrogen ammonium bisulfate; tris(3,5-di-t-butylsalicylato) aluminum available from Orient Chemical Co.; potassium bis(3,5-di-t-butylsalicylato) borate available from Japan Carlit as LR120; TN1001 believed to be a calcium salt of salicylic acid and available from Hodogaya Chemical; tertiarybutyl salicylic acid complexes; mixtures thereof; and the like.

The blend compatibility components are generally present in various effective amounts, such as for example from about 0.01 to about 10 percent by weight. Preferably the blend compatibility components are present in an amount of from about 0.01 to about 5 percent by weight, and more preferably from about 0.01 to about 1 percent by weight. However, the amount of the blend compatibility components selected for a given toner composition may vary, depending for example upon the specific blend compatibility component selected, and whether it is incorporated into the toner composition as an internal or external additive.

As resin materials, the base color toners of the present invention may utilize any of the numerous suitable resins, such as thermoplastic resins, known in the art to be useful in producing toners and developers. Suitable resins that may be utilized in the present invention include but are not limited to olefin polymers such as polyethylene, polypropylene and the like; polymers derived from dienes such as polybutadiene, polyisobutylene, polychloroprene and the like; vinyl and vinylidene polymers such as polystyrene, styrene butyl methacrylate copolymers, styrene butylacrylate copolymers, styrene butadiene copolymers, styrene-acrylonitrile copolymers, acrylonitrile-butadiene styrene terpolymers, polymethylmethacrylate, polyacrylate, polyvinyl alcohol, polyvinyl chloride, polyvinyl carbazole, polyvinyl ethers, polyvinyl ketones and the like; fluorocarbon polymers such as polytetrafluoroethylene, polyvinylidene fluoride and the like; heterochain thermoplastics such as polyamides, polyesters, polyurethanes, polypeptides, casein, polyglycols, polysulfides, polycarbonates and the like; and cellulosic copolymers such as regenerated cellulone, cellulose acetate, cellulose nitrate and the like; and mixtures thereof. Of the vinyl polymers, resins containing a relatively high percentage of styrene are preferred, such as homopolymers of styrene or styrene homologs of copolymers of styrene. One preferred resin for use in the base color toners of the present invention is a copolymer resin of styrene and n-butylmethacrylate. Another preferred resin used in the present invention is a styrene butadiene copolymer resin with a styrene content of from about 70 to about 95 percent by weight, such as PLIOTONE™ available from Goodyear Chemical.

In embodiments of the present invention, the base color toners may contain the same or different toner resins. Thus, in embodiments, each of the separate base color toners that is blended to formulate the final color toner composition may contain a different toner resin, provided that the improved blend compatibility is achieved. However, in other embodiments, it may be desired that each of the separate base color toners being mixed to form the final customer selectable color toner contain the same toner resin.

The resins are generally present in the toner of the invention in an amount of from about 40% to about 98% by weight, and more preferably from about 70% to about 98% by weight, although they may be present in greater or lesser amounts, provided that the objectives of the invention are achieved. For example, toner resins of the invention can be subsequently melt blended or otherwise mixed with a colorant, charge carrier additives, surfactants, emulsifiers, pigment dispersants, flow additives, and the like. The resultant product can then be pulverized by known methods such as milling to form toner particles. The toner particles preferably have an average volume particle diameter of about 5 microns to about 25 microns, more preferably about 5 microns to about 15 microns, and even more preferably from about 8 microns to about 12 microns.

Various suitable colorants can be employed in toners of the invention, including suitable colored pigments, dyes, and mixtures thereof including Carbon Black, such as Regal 330® carbon black (Cabot), Acetylene Black, Lamp Black, Aniline Black, Chrome Yellow, Zinc Yellow, Sicofast Yellow, Luna Yellow, Novaperm Yellow, Chrome Orange, Bayplast Orange, Cadmium Red, Lithol Scarlet, Hostaperm Red, Fanal Pink, Hostaperm Pink, Lithol Red, Rhodamine Lake B, Brilliant Carmine, Heliogen Blue, Hostaperm Blue, Neopan Blue, PV Fast Blue, Heliogen Green, Cinquassi Green, Hostaperm Green, titanium dioxide, cobalt, nickel, iron powder, Sicopur 4068 FF, and iron oxides such as Mapico Black (Columbia), NP608 and NP604 (Northern Pigment), Bayferrox 8610 (Bayer), MO8699 (Mobay), TMB-100 (Magnox), mixtures thereof and the like.

The colorant, preferably carbon black, cyan, magenta, yellow, red, blue and/or green colorant, is incorporated in an amount sufficient to impart the desired color to the toner. In general, pigment or dye is employed in an amount ranging from about 2% to about 60% by weight, and preferably from about 2% to about 10% by weight for color toner and about 5% to about 50% by weight for black toner.

Various known suitable effective positive or negative charge enhancing additives can be selected for incorporation into the toner compositions of the present invention, preferably in an amount of about 0.1% to about 10% by weight, and more preferably about 1% to about 3% by weight. Examples include quaternary ammonium compounds inclusive of alkyl pyridinium halides; alkyl pyridinium compounds, as disclosed in U.S. Pat. No. 4,298,672, the disclosure of which is totally incorporated herein by reference; organic sulfate and sulfonate compositions, as disclosed in U.S. Pat. No. 4,338,390, the disclosure of which is totally incorporated herein by reference; cetyl pyridinium tetrafluoroborates; distearyl dimethyl ammonium methyl sulfate; zinc and aluminum salts, such as Bontron E84™ or E88™, respectively (Orient Chemical); and the like.

Additionally, other internal and/or external additives may be added in known amounts for their known functions.

The resulting toner particles optionally can be formulated into a developer composition by mixing with carrier particles. Illustrative examples of carrier particles that can be selected for mixing with the toner composition prepared in accordance with the present invention include those particles that are capable of triboelectrically obtaining a charge of opposite polarity to that of the toner particles. Accordingly, in one embodiment the carrier particles may be selected so as to be of a negative polarity in order that the toner particles which are positively charged will adhere to and surround the carrier particles. Illustrative examples of such carrier particles include granular zircon, granular silicon, glass, steel, nickel, iron ferrites, silicon dioxide, and the like. Additionally, there can be selected as carrier particles nickel berry carriers as disclosed in U.S. Pat. No. 3,847,604, the entire disclosure of which is totally incorporated herein by reference, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326, the disclosures of which are totally incorporated herein by reference.

The selected carrier particles can be used with or without a coating, the coating generally being comprised of fluoropolymers, such as polyvinylidene fluoride resins, terpolymers of styrene, methyl methacrylate, and a silane, such as triethoxy silane, tetrafluoroethylenes, other known coatings and the like.

The diameter of the carrier particles is generally from about 50 microns to about 1,000 microns, preferably about 200 microns, thus allowing these particles to possess sufficient density and inertia to avoid adherence to the electrostatic images during the development process. The carrier particles can be mixed with the toner particles in various suitable combinations. However, best results are obtained when about 2 percent to about 10 percent by weight of toner and from about 98 percent to about 90 percent by weight of carrier are mixed.

According to the present invention, two or more of the compatible base color toners may be combined in various proportions to provide a final toner composition of a desired color. The final color toner composition is created by mixing, in the correct proportions, two or more of the base color toners, such as those described above.

Procedures and criteria for selecting specific colors, and for determining the proportions in which the colors are mixed, are known to those skilled in the art or can be determined by routine computation or routine experimentation. For example, a set of base color toners corresponding to the colors red, blue and green and the three subtractive primary colors cyan, magenta and yellow may be combined to form a wide variety of colors. The proportion of constituent base color toners can vary substantially, such proportions depending on the color desired. For example, a cyan base color toner may be blended with a magenta base color toner in various proportions to provide a final toner composition with varying hues of blue, purple, and violet, depending on the ratio of base color toners being blended. Similarly, as a further example, magenta and red base color toners may be mixed in various proportions to provide varying hues of red in a final toner composition.

Furthermore, the set of base color toners used to formulate the specific final color toner compositions for use in the present invention may include black, white and/or clear base color toners. The black base color toner may be mixed with the other base color toners to provide a darker final toner composition. Similarly, the white or clear base color toner may be mixed with the other base color toners to create a paler final color toner composition, without the use of halftones or tints that are often required in many color copying and printing processes and applications. Additionally, the black and white base color toners may be separately mixed to provide final toner compositions having varying shades of gray.

In embodiments of the present invention, the constituent, separate base color toners may be pre-blended in the factory and shipped as a single specific color in a single container. That is, the various base color toners may be pre-blended in the appropriate proportions to produce a specific color, with that specific color toner composition then being packaged and shipped to a customer. By pre-blending the various color toner compositions in the factory, it may be assured that the base color toners are mixed in the exact proportion so as to ensure a consistent final color over multiple blending batches. The pre-blended final color toner composition also ensures that the color of the final toner composition does not vary over time during use of the toner, and simplifies handling in that only a single toner dispenser is required in the imaging device for a given color.

If the base color toners are to be pre-blended prior to shipment, the pre-blending may be conducted according to any of various methods known in the art. For example, the blending may be conducted by forming a mixture of the base color toners in their powdered form, as disclosed in U.S. Pat. No. 4,395,471, the entire disclosure of which is incorporated herein by reference. However, certain advantages may be obtained by blending the base color toners in pellet form, that is, prior to grinding the toner pellets into a powdered toner composition. The process generally comprises mixing two or more color toners, in pellet form and in appropriate ratios, and grinding the mixture, to produce a final toner composition of a desired specific color. In embodiments, the separate toner pellets may be first mixed and then ground, or the various color toner pellets may be separately fed directly into a grinding device in the correct proportion to produce the desired end color. By the mixing action of the grinder, the separate color toner pellets are both ground and mixed together to form a homogeneous powdered mixture. As starting toner pellet compositions may be used any conventional color toners, such as those prepared in an extruding process, which have not been ground into a powdered form. This grinding process permits multiple toner pellets of different colorant, resin, and additive compositions to be mixed and ground to yield a different, homogeneously mixed, final color toner powder.

Whereas known methods, such as that disclosed in U.S. Pat. No. 4,395,471, complete the process of separately preparing different color toner particles by grinding the toner pellets, this step need not be immediately conducted in the present invention. Rather, the toner pellets of the base color toners may be stored for eventual final processing into the specifically desired final color toner. Storage and further handling and processing of the toner pellets are much more convenient than similar processing of the powdered toners. Once the pellets are ground into their final powder form, the blend compatibility components may be added, as described above.

Because of the advantages achieved in blending the toner pellets, it is preferred in some embodiments of the present invention that the pre-blended final toner composition be produced by blending the base color toners in their pellet forms, concurrent with or followed by grinding of the toner pellet blend. However, in other embodiments of the present invention it is preferred that the base color toners be processed into final toner compositions (i.e., ground into powdered form, classified, etc.) prior to blending the separate base color toners into a final toner composition.

In other embodiments of the present invention, the base color toners are not pre-blended to form the final color toner composition. Instead, the individual base color toners may be shipped to customers in separate containers, and blended during actual use of the toner compositions. In this way, the individual base color toners may be blended real-time as they are dispensed into a single color developer housing, allowing real-time color correction and adjustment. For example, in a development apparatus having multiple toner composition dispensers (for example, toner cartridges) attached to a single developer housing, it may be possible for the user to adjust the dispense rates of the base color toners from the individual dispensers into the developer housing, thereby adjusting the color of the final toner composition being utilized in the development apparatus.

In embodiments according to this latter approach, a single developer housing may be connected to two or more dispensers, such as cartridges. The apparatus may operate either with the dispensers dispensing pure toner without carrier particles or as a so-called "trickle-through" system with the dispensers dispensing a combination of toner and carrier particles known as a "replenisher." These processes are described in more detail below. In either case, either the separate dispensers or the developer housing may be equipped with means to control and adjust the dispense rates from the respective dispensers. Such means may be adjustable so as to allow each individual dispenser to provide anywhere from 0 to 100 percent of the required toner or replenisher from each dispenser during printing. That is, depending on the final specific color selected, the dispensing means may be adjusted to either prevent any toner or replenisher from being supplied from a given dispenser, or to allow a given dispenser to provide all of the toner or replenisher required for printing (i.e., all of the toner or replenisher is provided by one dispenser, with the other dispenser(s) "closed").

As toner or replenisher is being introduced into the development housing, either from a single or multiple dispensers, the toner or replenisher may in embodiments be continually mixed so as to ensure a homogeneous blend of toner and carriers in the developer housing. Such mixing may be conducted, for example, by means of any of various mechanical mixing devices and methods known and used in the art.

In embodiments of the present invention, an electrostatographic imaging device is provided, wherein the device comprises two or more separate developer housings. In embodiments containing two or more developer housings, the multiple developer housings may be contained in a single electrostatographic module wherein the photoreceptor or imaging member makes a single pass through the system, such as in a tri-level imaging system, or makes multiple passes through the system. The multiple developer housings may also be incorporated into the device in the form of multiple complete electrostatographic modules, each comprising a separate charging, exposure, development, transfer and cleaning step, such as a tandem engine. Furthermore, in embodiments, the multiple housings may be incorporated into a cyclic or single pass process color electrostatographic engine with the blended final toner composition in an additional housing to be used for specialty or spot color.

In embodiments of the present invention, the normal mode of operating the development machine would be to have the same color toner blend (the final color toner composition comprising two or more base color toners) in both the developer housing and the dispenser. This mode of operation will typically occur where pre-blended final color toner compositions are being used, and shipped to the consumer in a single dispenser. However, in embodiments of the present invention, it is possible to start a print run with one color or blend in the developer housing and another color or blend in the dispenser. In this manner, the end-user may have the option of creating multiple highlight colors in a single print run. For example, if a different color toner composition blend is introduced in the dispenser, the hue of the final toner composition would change continuously over a print run of several hundred prints, the number of prints depending on area coverage, developability, and other factors.

In particular, the developer housing or housings used in the process of the present invention may encompass both traditional developer housings and those used in the so-called "trickle-through" development system. In traditional developer housings, the developer housing is filled with an initial charge of a developer composition, typically comprising from about 1 to about 10 percent toner and from about 99 to about 90 percent carrier by weight. Preferably, the initial charge of developer comprises from about 2 to about 5 percent toner and from about 98 to about 95 percent carrier by weight. A dispenser attached to the developer housing dispenses pure toner into the developer housing at a rate approximately equal to the rate at which the toner is being used in the printing process. In a trickle-through process, however, the dispenser contains so-called "replenisher" typically comprising from about 20 to about 80 percent toner and from about 80 to about 20 percent carrier by weight. While additional replenisher is being added to the developer housing, a small amount of developer is continuously being removed from the developer housing by means of a drop tube or other mechanism; the rate of addition being approximately equal to the rate of toner usage and developer removal. Such a trickle-through system is disclosed in U.S. Pat. No. 4,614,165, the entire disclosure of which is incorporated herein by reference.

The process of the present invention may be incorporated into any of various electrostatographic imaging processes and devices known in the art. For example, the process of the present invention is especially suited for use in a hybrid development system, such as that disclosed in U.S. Pat. No. 5,032,872, and a tri-level electrostatographic system, such as that disclosed in U.S. Pat. No. 4,078,929, the entire disclosure of these two U.S. patent references being incorporated herein by reference.

In embodiments of the present invention utilizing a hybrid development or hybrid scavengeless development system, blends of two or more base color toners may be utilized in a single developer housing to achieve a broad range of specific customer selectable colors. If a print engine with only one such developer housing is used, the result is single-color prints or copies in the specific customer selectable color. However, as is known in the art, multiple developer housings may be co-resident in the print engine, thus resulting in a color printer producing one-color prints (if all developer housings contain the same color toner composition) or multi-color prints (if developer housings contain different color compositions). For example, in an embodiment comprising two co-resident developer housings, one developer housing may contain a color toner composition, and the other developer housing may contain a black toner composition. The result is a highlight two-color printer with a customer selectable highlight color. In another embodiment of the present invention, three or more developer housings may be used for process color printing, for example, with cyan, magenta, yellow and black toner compositions, and an additional developer housing or housings is provided with a blend of the base color toners for customer selectable specialty, highlight or spot color(s).

Similarly, the process of the present invention may be utilized in a tri-level development apparatus having two separate developer housings. In this tri-level development apparatus, one of the developer housings may contain a specific customer selectable color, with the other developer housing containing either a black toner composition or another specific customer selectable color. In this apparatus, one of the developers will be relatively negatively charged with respect to an intermediate potential of the latent image, and the other developer will be relatively positively charged.

Figure 3:
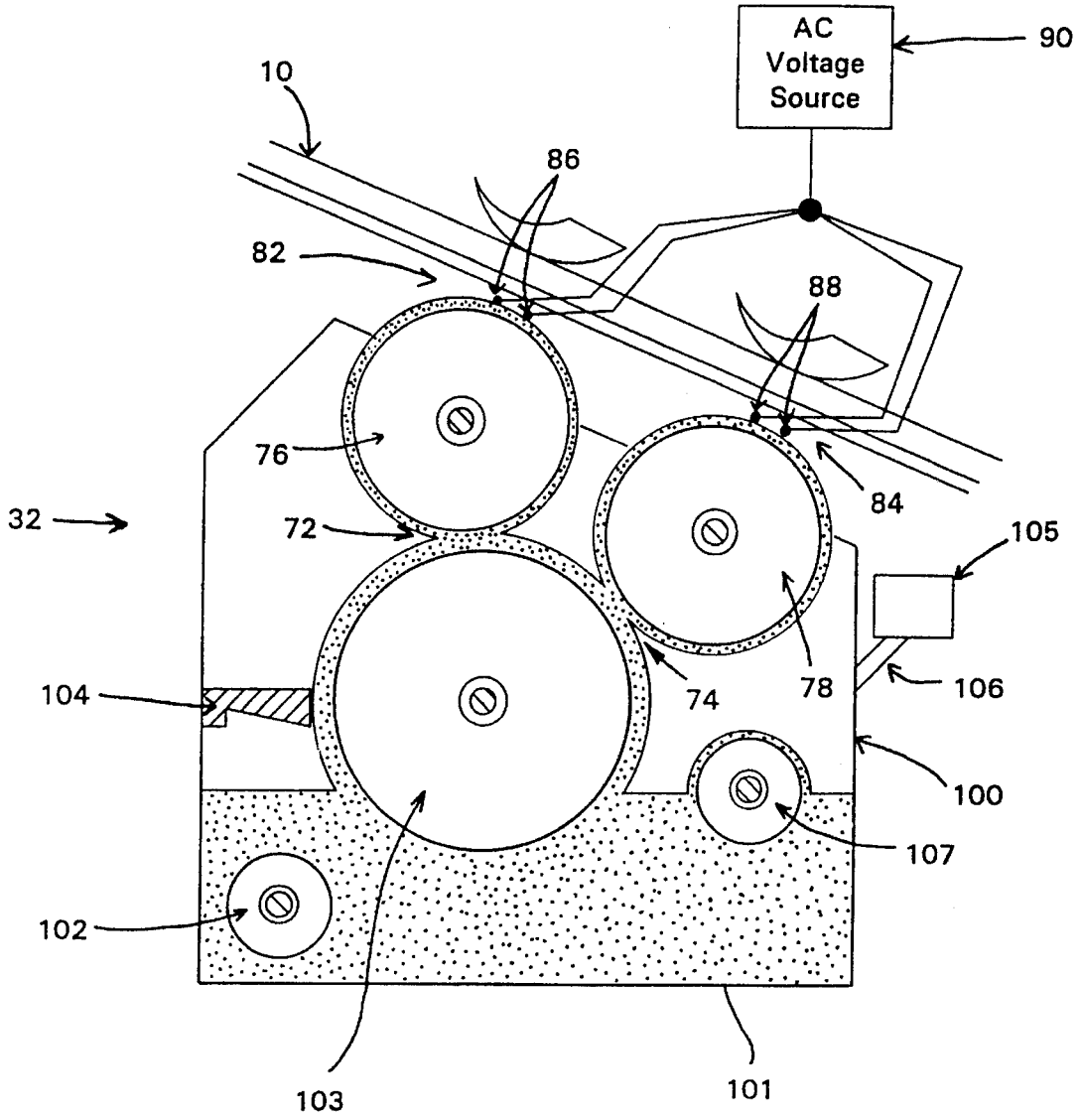
FIG. 3 is a schematic diagram depicting a hybrid scavengeless development housing with two pairs of electrode wires for use in an imaging device.
Figure 4:
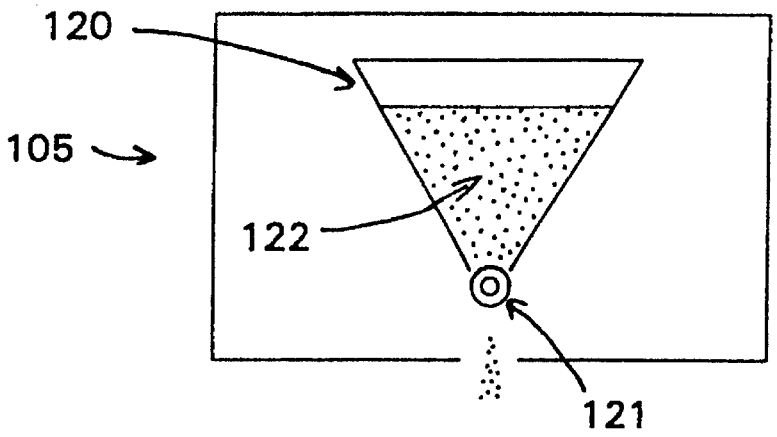
FIG. 4 shows one embodiment of a toner or developer dispenser.
Figure 5:
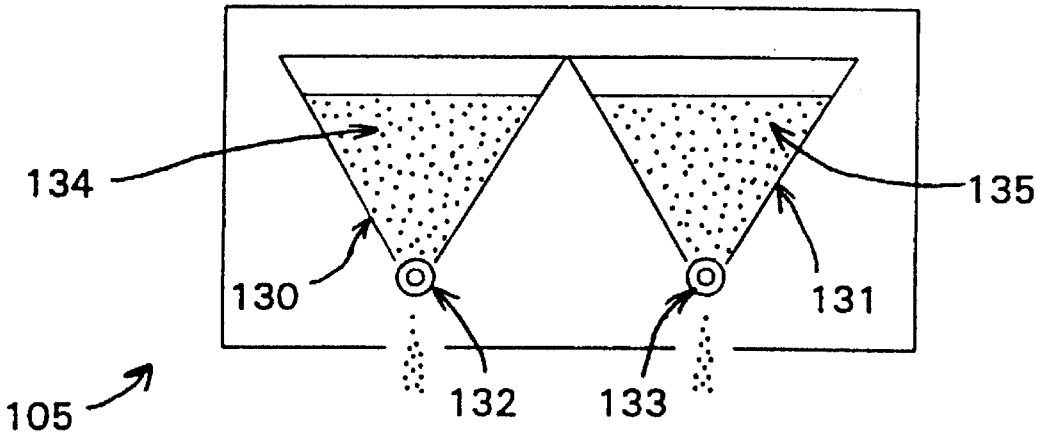
FIG. 5 shows a second embodiment of a toner or developer dispenser.

The electrostatographic imaging system of the present invention will now be described in more detail with reference to the figures. FIGS. 1–5 schematically depict the various components of illustrative electrophotographic imaging devices. It will become evident from the following discussion that the process of the present invention is equally well suited for use in a wide variety of electrostatographic printing machines, including electrophotographic and ionographic printing machines. Because the various processing stations and elements employed in the printing machines of FIG. 1 and FIG. 2 and the components of FIGS. 3–5 are well-known, they are shown schematically and their operation will be described only briefly. In the drawings, like reference numerals are used throughout to designate like elements.

FIG. 1 depicts a printing machine containing a single developer housing. The printing machine shown in FIG. 1 employs an imaging belt 10 of any suitable type, which moves in the direction of arrow 12 to advance successive portions of the surface of the belt 10 through the various stations disposed about the path of movement thereof. As shown, belt 10 is entrained about rollers 14 and 16, which are mounted to be freely rotatable, and drive roller 18, which is rotated by a motor 20 to advance the belt in the direction of the arrow 12.

Initially, a portion of belt 10 passes through a charging station A. At charging station A, a corona generation device, indicated generally by the reference numeral 22, charges a portion of the surface of belt 10 to a relatively high, substantially uniform potential.

Next, the charged portion of the surface is advanced through an exposure station B. At exposure station B, the charged portion of the surface is exposed to an image, such as an image of an original document being reproduced, or to a computer-generated image written by a raster output scanner, the exposure apparatus being generally referred to as exposure apparatus 24. The specific apparatus for the exposure station is known in the art, and need not be described in further detail. The charge on the surface is selectively dissipated, leaving an electrostatic latent image on the surface that corresponds to the original document or computer image. The belt 10 then advances the electrostatic latent image to a development station C.

At development station C, a development apparatus indicated generally by the reference numeral 32 transports toner particles to develop the electrostatic latent image recorded on the surface of belt 10. Here, the toner particles are a blend of base color toner compositions forming a developer composition of a different specific customer selectable color. The development apparatus 32 may be comprised of any of various developer housings known in the art, and may contain one or more donor rolls, shown in FIG. 1 as donor rolls 76 and 78. A typical development apparatus is described in detail in U.S. Pat. No. 5,032,872, the entire disclosure of which is incorporated herein by reference. Toner particles are transferred from the development apparatus to the latent image on the belt, forming a toner powder image on the belt, which is advanced to transfer station D.

At transfer station D, a sheet of support material 38, typically a sheet of paper or transparency, is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the surface of belt 10 in a timed sequence so that the toner powder image developed thereon contacts the advancing sheet of support material at transfer station D. Alternatively, the support material 38 may be fed into transfer station D as a continuous sheet or web, and optionally cut into sheet form subsequent to transfer.

Transfer station D includes a corona generating device 48 which sprays ions onto the back side of support material 38. This attracts the toner powder image from the surface of belt 10 to support material 38. After transfer, the support material continues to move in the direction of arrow 50 into a conveyor (not shown) that advances the support material to fusing station E.

Fusing station E includes a fusing assembly, indicated generally by the reference numeral 52, which permanently affixes the transferred powder image to support material 38. Preferably, fuser assembly 52 includes a heated fuser roller 54 and back-up roller 56. Support material 38 passes between fuser roller 54 and back-up roller 56 with the toner powder image contacting fuser roller 54. In this way, the toner powder image is permanently affixed to the support material 38. After fusing, and optional cutting if continuous sheet or web fed, chute 58 guides the advancing support material to catch tray 60 for subsequent removal from the printing machine by the operator.

Invariably, after the support material is separated from the surface of belt 10, some residual toner particles remain adhering thereto. These residual particles are removed from the surface at cleaning station F. Cleaning station F may include a pre-clean corona generating device (not shown) and a rotatably mounted fibrous brush 62 in contact with the surface of belt 10. The pre-clean corona generating device neutralizes the charge attracting the particles to the surface. These particles are cleaned from the surface by the rotation of brush 62 in contact therewith. Subsequent to cleaning, an exposure system (not shown) may be used to dissipate any residual charge remaining thereon prior to the charging thereof for the next successive imaging cycle.

Figure 2:
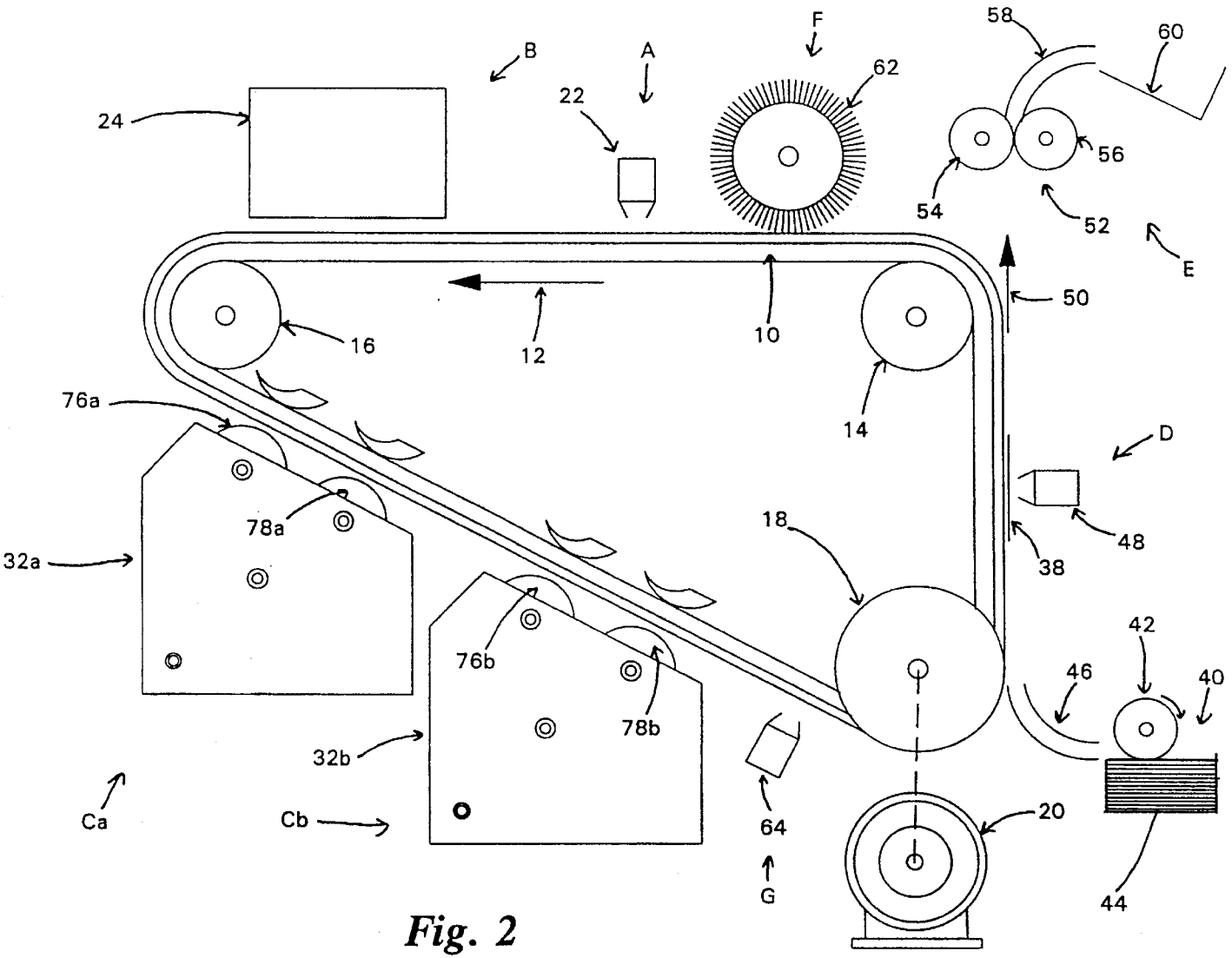
FIG. 2 is a schematic diagram depicting an illustrative electrostatographic imaging device, such as a tri-level development system, incorporating multiple developer housings.

FIG. 2 depicts a printing machine containing two separate developer housings. The printing machine operates in substantially the same manner as the printing machine of FIG. 1, so only the different components will be discussed herein. As with the printing machine of FIG. 1, a belt 10 moves in the direction of arrow 12 to advance successive portions of the surface of the belt through the various stations disposed about the path of movement thereof.

After the belt 10 is charged to a high potential in charging station A, and the charge is selectively dissipated in exposure station B, the belt 10 then sequentially advances the electrostatic latent image to development stations Ca and Cb.

Development stations Ca and Cb operate substantially in the same manner as each other, with one of development stations Ca and Cb developing portions of the electrostatic latent image of one potential, and the other of the development stations developing portions of the electrostatic latent image of another potential. For example, in a tri-level development system where the latent image is provided at three potentials, one development station will develop the relatively positively charged (with respect to an intermediate potential corresponding to background portions of the image) portions of the latent image, while the other development station will develop relatively negatively charged portions of the electrostatic latent image.

At development station Ca, a development apparatus indicated generally by the reference numeral 32*a*, transports developer to develop portions of the electrostatic latent image recorded on the surface of the belt 10. The development apparatus 32*a* may be any of various developer housings known in the art, and may contain one or more donor rolls, shown in FIG. 2 as donor rolls 76*a* and 78*a*. The development apparatus may be identical to or similar to the development apparatus of FIG. 1. For example, a conductive magnetic brush system or a hybrid scavengeless development system may be substituted for one or both of development apparatus 32*a* and 32*b*. Toner particles with a charge of either polarity are transferred from the development apparatus to the latent image of the appropriate potential on the belt, forming a toner powder image on the belt, which is advanced to development station Cb. After similar processing in development station Cb, which contains toner of the opposite sign charge from the toner in development station Ca, the belt is advanced to a pre-transfer station G. In this embodiment, at least one of development apparatus 32*a* and 32*b* will contain the developer composition of the present invention. Thus, in the respective developer station, the toner particles forming the toner powder image on the belt will be a blend of the compatible base color toner compositions contained in the developer composition.

At pre-transfer station G, the belt 10 carrying the developed toner powder image is advanced by a corona charging unit, indicated generally by the reference numeral 64. The corona charging unit 64 charges the toner powder on the belt 10 so that all of the toner powder has the same sign (polarity). The belt 10 is then advanced through the remaining stations disposed about the path of the belt 10.

FIG. 3 depicts details of a hybrid scavengeless development apparatus 32 for use in the present invention. The apparatus comprises a reservoir 100 containing developer material 101. The reservoir includes augers 102, which are rotatably mounted in the reservoir chamber. The augers 102 serve to transport and agitate the material within the reservoir and encourage the toner particles to adhere triboelectrically (in the case of a two-component developer) to the carrier granules. A magnetic brush roll 103 transports developer material from the reservoir 100 to the loading nips 72 and 74 of two donor rolls 76 and 78, respectively. A metering blade 104 removes excess developer material from the magnetic brush roll 103 and ensures an even depth of coverage with developer material 101 before arrival at the first donor roll loading nip 72, where only toner is transferred from the magnetic brush roll 103 to the donor roll 76. Toner from developer material 101 is similarly transferred from the magnetic brush roll 103 to the donor roll 78 at loading nip 74. That is, carrier particles in the developer material 101 are not transferred to the donor rolls 76 and 78.

Each of donor rolls 76 and 78 transport toner particles to the respective development zones 82 and 84, through which the belt 10 passes. At each of the development zones 82 and 84, toner is transferred from the respective donor roll 76 and 78 to the latent image on the belt 10 to form a toner powder image on the belt 10. Although various methods exist for achieving an adequate transfer of toner from donor rolls to a surface of belt 10, FIG. 3 shows the development zones 82 and 84 as having a multitude of electrode wires, in this case two electrode wires, disposed in the space between each donor roll 76 and 78 and the belt 10. For each of donor rolls 76 and 78, the respective electrode wires 86 and 88 extend in a direction substantially parallel to the longitudinal axis of the respective donor roll. An alternating electrical bias is applied to the electrode wires 86 and 88 by an AC voltage source 90. The electrostatic field thus created is effective in detaching toner from the surface of the donor roll and forming a toner cloud about the wires, the height of the cloud being such that the cloud is not substantially in contact with the belt 10. A DC bias voltage (not shown) attached to the donor rolls 76 and 78 establishes electrostatic fields between the latent image on the belt 10 and donor rolls 76 and 78 for attracting the detached toner particles from the clouds surrounding the wires to the latent image recorded on the surface of the belt 10. The operation of the donor rolls and electrode wires, and subsequent development of a latent image, is described in more detail in U.S. Pat. No. 5,032,872 and U.S. Ser. No. 07/396,153 filed Aug. 11, 1989 (now abandoned), the entire disclosures of which are incorporated herein by reference.

However, in another embodiment of the hybrid scavengeless system, the electrode wires may be absent. For example, a jumping development system may be used wherein an AC voltage is applied to the donor roll, causing toner to be detached from the donor roll and projected towards the imaging member surface.

After development, excess toner may be stripped from donor rolls 76 and 78 by respective cleaning blades (not shown) so that magnetic brush roll 103 meters fresh toner to the clean donor rolls. As successive electrostatic latent images are developed, the toner particles within the developer material 101 are depleted. A toner or replenisher dispenser 105, such as those shown in FIGS. 4 and 5, stores a supply of toner particles, with or without carrier particles. The dispenser 105 is in communication with reservoir 100 and, as the concentration of toner particles in the developer material 101 is decreased, or as carrier particles are removed from the reservoir 100 as in a "trickle-through" system, fresh toner or replenisher is furnished to the developer material 101 in the reservoir 100, for example by inlet 106. The augers 102 in the reservoir chamber mix the fresh toner or replenisher particles with the remaining developer material 101 so that the resulting developer material therein is substantially uniform, with the concentration of toner particles being optimized. Additionally, further optional augers 107 may be included to increase the mixing efficiency. In the case of a "trickle-through" system, the developer housing 32 may also comprise an outlet (not shown) for removing carrier particles from the developer material 101.

FIG. 4 depicts one embodiment of a toner or replenisher dispenser 105 of the present invention. The dispenser 105 includes an open-ended hopper 120 having a dispensing means such as a foam roller 121 positioned in the open end thereof. A supply of toner or replenisher material (comprising toner particles or a mixture of carrier particles and toner particles), referred to generally as material 122, is stored in hopper 120. As roller 121 rotates, the material 122 is discharged from the hopper 120 into a development apparatus (not shown). The dispensing means may be adjusted to control the dispense rate of material 122 from hopper 120.

FIG. 5 depicts another embodiment of a toner or replenisher dispenser 105 of the present invention. The dispenser 105 includes two open-ended hoppers 130 and 131, each having a dispensing means such as a foam roller 132 and 133, respectively, positioned in the open ends thereof. A supply of toner or replenisher material (comprising toner particles or a mixture of carrier particles and toner particles), referred to generally as materials 134 and 135, is stored respectively in hoppers 130 and 131. As rollers 132 and 133 rotate the materials 134 and 135 are discharged from the hoppers 130 and 131 into a development apparatus (not shown). The dispensing means may be adjusted to control the dispense rates of materials 134 and 135 from hoppers 130 and 131. Additionally, in embodiments the dispensing means may be independently controlled of each other, if desired.

One skilled in the art will recognize that the above toner compositions, development processes, and development apparatus may be altered and adjusted as necessary to achieve desired and optimum results. The invention will now be described in detail with reference to examples of specific preferred embodiments thereof. All parts and percentages are by weight unless otherwise indicated.

EXAMPLES

Example 1

A brown colored final toner composition is prepared as a blend of portions of a green base color toner composition and a red base color toner composition. The green base color toner is prepared by adding to an extrusion device 92 percent by weight of suspension polymerized styrene butadiene copolymer resin particles (87/13), 7 percent by weight of the pigment Heliogen Green (available from BASF), and 1 percent by weight of the charge enhancing additive distearyl dimethyl ammonium methyl stearate. The strands of product exiting from the extruder are cooled by immersion in a water bath maintained at room temperature and then air dried. A red base color toner is prepared the same as the green base color toner, except that the pigment is substituted with 6.72 percent by weight of Lithol Scarlet and 0.28 percent by weight of Hostaperm Pink (available from Hoechst A.G.). As with the green toner composition, the strands of product exiting from the extruder are cooled by immersion in a water bath maintained at room temperature and then air dried.

A final specific color toner composition is formed by mixing portions of the red and green base color toners. In pellet form, the extruded products are mixed in a ball mill. The resultant mixture is fed into a grinder, the mixture is ground to yield final color toner particles of from 8 to 12 microns in median diameter, and then classified. The toner particles are then mixed in a ball mill with 0.3 percent by weight of AEROSIL R972 and 0.3 percent by weight of zinc stearate. The mixing is conducted for 30 minutes. The result in a brown colored toner with excellent electrical characteristics.

A developer is then produced by mixing, in a roll mill for 60 minutes, 3 parts by weight of the final color toner and 97 parts by weight of carrier particles. The carrier particles comprise a steel core coated with 0.8 percent by weight of a polymer mixture of 20 parts by weight carbon black and 80 parts by weight polymethyl methacrylate. The resultant developer is then placed in a single development housing in a commercial electrostatographic print apparatus using a conductive magnetic brush development system.

Example 2

A brown colored final toner composition is prepared into a developer according to Example 1. A black developer is also prepared in the same manner as the green toner of Example 1, except that only 89 percent by weight of styrene butadiene copolymer resin is used and the pigment is substituted with 10 percent by weight of Regal 330® carbon black (available from Cabot). The black toner is formulated into a developer as in Example 1.

A commercial tri-level electrostatographic development apparatus is used to produce highlight color prints. The development apparatus contains two development housings. One of the development housings contains the black developer composition (toner and carrier); the other developer housing contains the brown developer composition.

Example 3

A hybrid scavengeless development system, such as the apparatus described in FIG. 3, is modified such that two toner dispensers are connected to the single development housing. Each of the toner dispensers is equipped with a foam roller to meter addition of the respective toner composition into the development housing. The rollers are adjusted such that the respective toner compositions are dispensed from each toner dispenser at a preset rate. In this Example, each of the green and red toner compositions is prepared as in Example 1, except that the individual toners are separately ground to a particle size of from 8 to 12 microns in median diameter, classified, and mixed in a ball mill with 0.3 percent by weight of a colloidal silica Aerosil R972 and 0.3 percent by weight of zinc stearate for 30 minutes. In one of the toner dispensers is provided the green base color toner and in the other toner dispenser is provided the red base color toner. The development housing initially contains a charge of brown colored developer prepared according to Example 1. As toner is dispensed from the dispensers, it is mixed with the carrier particles and other developer in the development housing, providing a brown colored developer composition.

What is claimed is:

1. An electrostatographic imaging process comprising:

a) forming an electrostatic latent image on an image forming device;

b) developing said electrostatic latent image on said image forming device with at least one first developer, said first developer comprising carrier particles and a blend of two or more toner compositions, said toner compositions being selected from the group consisting of toner compositions having blend compatibility components coated on an external surface of particles of said toner compositions and particulate toner compositions containing therein blend compatibility components or passivated pigments;

c) transferring said toner image to a receiving substrate and fixing it thereto.

2. A process according to claim 1, wherein said toner compositions have blend compatibility components coated on a surface of particles of said toner compositions.

3. A process according to claim 2, wherein said blend compatibility components are selected from the group consisting of aluminum complex salts, zinc complex salts, distearyl dimethyl ammonium methyl stearate, zinc salt complexes, aluminum salt complexes, organic sulfonates, trialkyl hydrogen ammonium bisulfates, tris(3,5-di-t-butylsalicylato) aluminum, potassium bis(3,5-di-t-butylsalicylato) borate, calcium salts of salicylic acid, tertiarybutyl salicylic acid complexes, and mixtures thereof.

4. A process according to claim 1, wherein said blend compatibility components are present in said toner compositions in an amount of from about 0.01 to about 10 percent by weight.

5. A process according to claim 1, wherein said toner compositions comprise passivated pigments.

6. A process according to claim 5, wherein said passivated pigments comprise at least one ionic dye complexed to an ion binding polymer.

7. A process according to claim 1, wherein at least one of said two or more toner compositions comprises a first resin different from a second resin contained in another of said two or more toner compositions.

8. A process according to claim 1, wherein at least one of said toner compositions is selected from the group consisting of black and white colored toner compositions.

9. A process according to claim 1, further comprising dispensing said blend of two or more toner compositions from a dispenser into a developer apparatus, wherein said developer apparatus comprises a means for mixing carrier particles with said blend of two or more toner compositions.

10. A process according to claim 1, wherein said blend of toner compositions is pre-mixed with said carrier particles in a single dispenser.

11. A process according to claim 1, wherein said two or more toner compositions are dispensed from separate dispensers and are blended in said developing step (b).

12. A process according to claim 11, further comprising adjusting the dispense rates of toner compositions contained in said separate dispensers.

13. A process according to claim 1, wherein said developing step (b) comprises transferring said first developer to at least one donor roll, delivering toner particles of said first developer on said at least one donor roll to said image forming surface, and developing said electrostatic latent image with said toner particles.

14. A process according to claim 13, wherein said developing step (b) further comprises electrically biasing at least one electrode member positioned between said donor roll and said image forming member to detach toner particles from said donor roll and to form a cloud of toner particles in a region between said donor roll and said image forming device.

15. A process according to claim 1, wherein said developing step (b) comprises developing a first portion of the electrostatic latent image with said first developer and developing a second portion of the electrostatic latent image with a second developer.

16. A process according to claim 15, wherein one of said first and second developers comprises a negatively charged toner of one color and the other of said first and second developers comprises a positively charged toner of a second color.

17. A process according to claim 16, wherein said first developer is contained in a separate developer housing from said second developer.

18. A process according to claim 1, wherein said latent image forming step (a) comprises forming said electrostatic latent image with at least one raster output scanner.

19. An electrostatographic imaging device, comprising:

a) means for forming an electrostatic latent image on an image forming device;

b) means for developing said electrostatic latent image on said image forming device containing at least one first developer, said first developer comprising carrier particles and a blend of two or more toner compositions, said toner compositions being selected from the group consisting of toner compositions having blend compatibility components coated on an external surface of particles of said toner compositions and particulate toner compositions containing therein blend compatibility components or passivated pigments;

c) means for transferring said toner image to a receiving substrate and fixing it thereto.

20. A device according to claim 19, wherein at least one of said two or more toner compositions comprises a first resin different from a second resin contained in another of said two or more toner compositions.

21. A device according to claim 19, wherein said developing means comprises a developer apparatus and a dispenser for dispensing said blend of two or more toner compositions into said developer apparatus, wherein said developer apparatus comprises a means for mixing carrier particles with said blend of two or more toner compositions.

22. A device according to claim 19, wherein said developing means comprises a developer chamber, a first dispenser for dispensing one of said two or more toner compositions into said developer chamber, and a second dispenser for dispensing another of said two or more toner compositions into said developer chamber.

23. A device according to claim 22, said developing means further comprising means for blending said two or more toner compositions in said developer chamber.

24. A device according to claim 22, said developing means further comprising means for adjusting dispense rates of toner compositions contained in said first and second dispensers.

25. A device according to claim 19, wherein said developing means comprises a first developer apparatus and a second developer apparatus, at least one of said first and second developer apparatus containing said first developer.

26. A device according to claim 25, wherein said first developer apparatus contains a negatively charged toner of one color and said second developer apparatus contains a positively charged toner of a second color.

27. A device according to claim 19, wherein said developing means comprises a developer housing for storing said first developer, a magnetic brush roll, at least one donor roll, and means for transferring toner particles from said donor roll to said image forming device.

28. A device according to claim 27, wherein said developing means further comprises at least one electrode member positioned between said donor roll said image forming device, and means for electrically biasing said electrode member to detach toner particles from said donor roll and to form a cloud of toner particles in a region between said donor roll and said image forming device.

29. A device according to claim 19, wherein said developing means comprises a conductive magnetic brush development apparatus.

30. A device according to claim 19, wherein said image forming means comprises a raster output scanner.

31. A device according to claim 19, wherein said developing means comprises at least four developer apparatuses, at least one said developer apparatus containing said first developer.

32. A device according to claim 31, wherein at least one other said developer apparatus contains a black colored developer composition.

* * * * *